US010669123B2

(12) United States Patent
Virta et al.

(10) Patent No.: US 10,669,123 B2
(45) Date of Patent: Jun. 2, 2020

(54) METHOD FOR AVOIDING UNWANTED SAFETY GEAR TRIPPING IN A SAFETY STOPPING SYSTEM OF AN ELEVATOR SYSTEM, A SAFETY STOPPING SYSTEM, AND AN ELEVATOR SYSTEM

(71) Applicant: KONE Corporation, Helsinki (FI)

(72) Inventors: Veli-Matti Virta, Helsinki (FI); Timo Vlasov, Helsinki (FI); Markus Salmi, Helsinki (FI); Jarkko Saloranta, Helsinki (FI)

(73) Assignee: KONE CORPORATION, Helsinki (FI)

( * ) Notice: Subject to any disclaimer, the term of this patent is extended or adjusted under 35 U.S.C. 154(b) by 352 days.

(21) Appl. No.: 15/839,282

(22) Filed: Dec. 12, 2017

(65) Prior Publication Data

US 2018/0186603 A1 Jul. 5, 2018

(30) Foreign Application Priority Data

Dec. 29, 2016 (EP) ..... 16207231

(51) Int. Cl.
*B66B 5/04* (2006.01)
*B66B 5/18* (2006.01)
*B66B 5/16* (2006.01)

(52) U.S. Cl.
CPC ..... *B66B 5/044* (2013.01); *B66B 5/16* (2013.01); *B66B 5/18* (2013.01)

(58) Field of Classification Search
CPC ..... B66B 5/04; B66B 5/044
See application file for complete search history.

(56) References Cited

U.S. PATENT DOCUMENTS 1,566,491 A 12/1925 Lindquist
1,624,260 A * 4/1927 Lilly et al. ..... B66B 5/04 192/140
2,274,000 A * 2/1942 Sahlin ..... B66B 5/22 187/376
4,083,432 A 4/1978 Lusti
4,565,264 A * 1/1986 Kunii ..... B66B 5/06 187/373

(Continued)

FOREIGN PATENT DOCUMENTS

EP 1840068 A1 10/2007
FR 2832139 A1 5/2003
JP 2626408 B2 7/1997

OTHER PUBLICATIONS

Search Report issued in European priority application 16207231, dated Jun. 28, 2017.

*Primary Examiner* — Minh Truong
(74) *Attorney, Agent, or Firm* — Birch, Stewart, Kolasch & Birch, LLP

(57) ABSTRACT

In an elevator system, so as to avoid unwanted safety gear tripping, the kinetic energy, which is caused by inertia of the overspeed governor rope to the lever arm, is dissipated by implementing fluid viscous damping to dampen the rotary movement of the spindle shaft to prevent unwanted safety gear tripping in the event when the upwards movement of the moving mass is decelerated by a machinery brake to perform a quick stop of the moving mass. The fluid viscous damping is effected by a viscous fluid damper which is arranged in the synchronization linkage mounted to the moving mass.

13 Claims, 3 Drawing Sheets

(56) References Cited

U.S. PATENT DOCUMENTS

| | | | | |
|---|---|---|---|---|
| 5,937,973 | A * | 8/1999 | Liebetrau | B66B 5/04 187/373 |
| 6,564,907 | B1 * | 5/2003 | Sasaki | B66B 5/04 187/286 |
| 7,128,189 | B2 | 10/2006 | Maury et al. | |
| 7,475,756 | B2 | 1/2009 | Maury et al. | |
| 9,873,592 | B2 * | 1/2018 | Powers | B66B 5/044 |
| 2003/0183457 | A1 | 10/2003 | Maury et al. | |
| 2004/0178023 | A1 * | 9/2004 | Maury | B66B 5/04 187/373 |
| 2013/0220739 | A1 | 8/2013 | Okada et al. | |
| 2013/0264149 | A1 * | 10/2013 | Okamoto | B66B 5/04 187/247 |

* cited by examiner

METHOD FOR AVOIDING UNWANTED SAFETY GEAR TRIPPING IN A SAFETY STOPPING SYSTEM OF AN ELEVATOR SYSTEM, A SAFETY STOPPING SYSTEM, AND AN ELEVATOR SYSTEM

FIELD OF THE INVENTION

The present invention relates to a method for avoiding unwanted safety gear tripping in a safety stopping system of an elevator system, a safety stopping system, and an elevator system.

BACKGROUND OF THE INVENTION

In prior art, an elevator system comprises an elevator car which is connected to a counterweight via suspension ropes which go over a traction wheel driven by a hoisting machine. The elevator car and the counterweight are both guided vertically by respective guide rails inside a shaft. In the following, the elevator car and the counterweight are referred to as the moving mass. The elevator system further comprises a safety circuit having a plurality of normally closed safety switches for monitoring the safety status of the elevator in normal operation. If the safety of the elevator is somehow compromised, at least one of the safety switches is opened, the hoisting machine is deenergized and machinery brakes are engaged so as to decelerate the moving mass for quick stop.

The elevator system further comprises an overspeed governor system for the elevator car, which has a governor rope loop directed up from the elevator car, over an overspeed governor pulley, then down and under a tension weight pulley connected to a tension weight and then up again to the elevator car to be connected to a synchronization linkage for tripping an elevator car safety gear. A corresponding overspeed governor system can be attached to the counterweight.

The synchronization linkage has synchronization levers which make the safety gear of the moving mass to engage the guide rails of the moving mass when at least a predetermined force is applied to the synchronization linkage by the governor rope. This predetermined force is acting against spring forces of synchronization lever springs such that the synchronization lever engages the safety gear when the force applied by the governor rope exceeds the synchronization lever spring force. The overspeed governor system supervises the speed of the moving mass, and, if this speed exceeds a predetermined tripping speed which is above a rated speed of the elevator, it activates the machinery quick stop operation and, simultaneously, decelerates the governor rope. This deceleration of the governor rope acts against the spring forces of synchronization lever springs such that the synchronization lever engages the safety gear, bringing the elevator car into an emergency stop.

To summarize, a quick stop operation of the machinery is initiated whenever the elevator safety circuit indicates a compromised safety status of the elevator. Additionally, if the compromised safety status is a result of an overspeed condition of the moving mass, detected by overspeed governor, an emergency stop operation is activated by engaging the safety gear of the moving mass.

However, in high rise elevators, the elevator travel and speed increase such that the inertia of the governor rope increases substantially. This brings a new challenge during elevator quick stops carried out by the hoisting machine brakes. Namely, when the overspeed governor rope having the increased length decelerate during the above explained quick stop, a large force is applied to the synchronization linkage, because the inertia of the overspeed governor rope is large. As a result, the decelerating governor rope is capable of producing forces to the synchronization linkage which exceed the needed force to engage the safety gear when the moving mass is decelerated. In other words, the safety gear might be unwantedly engaged or tripped during quick stop although the speed of the moving mass has not exceeded the predetermined tripping speed for engaging the safety gear.

One solution for preventing unwanted safety gear tripping is to increase the synchronization lever spring force. However, this has an effect on the design of the overspeed governor since the European lift standard EN-81-20 code requires that the tensile force in the overspeed governor rope produced by the governor, when tripped, shall be twice the force that is necessary to engage the safety gear via the synchronization linkage. Stronger synchronization leads to bigger overspeed governor rope tensile forces and, consequently a stronger and, thus, heavier overspeed governor rope due to required safety factor. If one wishes to increase the force required for tripping the safety gear by increasing the synchronization lever spring force to oppose the inertial force of the governor rope, then, due to the EN-81-20 code requirement, the tensile strength of the governor rope would have to be increased which would cause the need for redesigning of the overspeed governor system. It is evident that this will finally lead to elevator systems in which there is no more feasible design window for overspeed governor and safety gear system.

Prior art systems, as known from e.g. documents JP 2626408, U.S. Pat. Nos. 7,128,189, 7,475,756 utilize springs and U.S. Pat. No. 4,083,432 utilizes a spring loaded weight for the same purpose.

OBJECTIVE OF THE INVENTION

The objective of the invention is to alleviate the disadvantages mentioned above.

In particular, it is an objective of the present invention to provide a simple and cost-effective measure and means for preventing the overspeed governor rope inertia from unwantedly engaging the safety gear.

SUMMARY OF THE INVENTION

According to a first aspect, the present invention provides a method for avoiding unwanted safety gear tripping in a safety stopping system of an elevator system. The safety stopping system comprises a machinery brake for decelerating a moving mass so as to perform a quick stop of the moving mass, a safety gear mounted to the moving mass, an overspeed governor, an overspeed governor rope connected to the moving mass of the elevator system, and a synchronization linkage mounted to the moving mass for tripping the safety gear, the synchronization linkage comprising a lever arm having a first end pivotally connected to the overspeed governor rope and a second end fixedly connected to a spindle shaft to which a safety gear tripping arm for tripping the safety gear is connected. According to the invention kinetic energy caused by inertia of the overspeed governor rope to the lever arm is dissipated by implementing fluid viscous damping to dampen the rotary movement of the spindle shaft to prevent unwanted safety gear tripping when the upwards movement of the moving mass is decelerated by the machinery brake to perform a quick stop of the moving mass.

The technical effect of the invention is that it prevents the overspeed governor rope inertial forces from unwantedly engaging the safety gear. Further, existing overspeed governor components can be used to higher travels in high-rise elevators without redesigning them because unintended and unwanted activation of the safety gears does not happen in case of unplanned rapid stopping upwards.

In an embodiment of the method, the fluid viscous damping is performed by a fluid viscous damper acting on a member of the synchronization linkage.

In an embodiment of the method, the fluid viscous damping is performed by a fluid viscous damper cylinder acting on an arm or a rod connected to the spindle shaft.

In an embodiment of the method, fluid viscous damping is performed by an oil damper cylinder.

In an embodiment of the method, the damping force is a non-linear function of velocity of a piston relative to a cylinder of the fluid viscous damper cylinder.

In an embodiment of the method, in velocities of the piston relative to the cylinder of the fluid viscous damper cylinder smaller than a predetermined velocity the damping force is arranged to increase more forcibly than in higher velocities.

In an embodiment of the method, the moving mass is an elevator car.

In an embodiment of the method, the moving mass is a counterweight.

According to a second aspect, the present invention provides a safety stopping arrangement for an elevator system for stopping the movement of a moving mass. T the safety stopping arrangement comprises a machinery brake for decelerating a moving mass so as to perform a quick stop of the moving mass, a safety gear mounted to the moving mass, an overspeed governor, an overspeed governor rope attached to a moving mass of the elevator system, and a synchronization linkage mounted to the moving mass for tripping the safety gear, the synchronization linkage comprising a lever arm having a first end pivotally connected to the overspeed governor rope and a second end, a spindle shaft to which the second end of the lever arm is fixedly connected, and a safety gear tripping arm for tripping the safety gear, the safety gear tripping arm being fixedly connected to the spindle shaft. According to the invention the safety stopping arrangement comprises a fluid viscous damper arranged to dissipate kinetic energy caused by inertia of the overspeed governor rope to the lever arm to dampen the rotary movement of the spindle shaft.

In an embodiment of the safety stopping arrangement, the fluid viscous damper is arranged to act on a member of the synchronization linkage.

In an embodiment of the safety stopping arrangement, the fluid viscous damper is a fluid viscous damper cylinder acting on an arm or a rod connected to the spindle shaft.

In an embodiment of the safety stopping arrangement, the fluid viscous damper is an oil damper cylinder.

In an embodiment of the safety stopping arrangement, the damping force is a non-linear function of velocity of a piston relative to a cylinder of the fluid viscous damper cylinder.

In an embodiment of the safety stopping arrangement, moving mass is an elevator car.

In an embodiment of the safety stopping arrangement, moving mass is a counterweight.

According to a third aspect, the present invention provides an elevator system comprising a moving mass guided by a pair of guide rails to be vertically movable in an elevator shaft, a suspension rope attached to the moving mass, a traction wheel over which the suspension rope is lead, a hoisting machine for driving the traction wheel to move the moving mass. According to the invention the elevator system comprises a safety stopping arrangement according to the second aspect.

It is to be understood that the aspects and embodiments of the invention described above may be used in any combination with each other. Several of the aspects and embodiments may be combined together to form a further embodiment of the invention.

BRIEF DESCRIPTION OF THE DRAWINGS

The accompanying drawings, which are included to provide a further understanding of the invention and constitute a part of this specification, illustrate embodiments of the invention and together with the description help to explain the principles of the invention. In the drawings.

DETAILED DESCRIPTION OF THE INVENTION

In the following, description will be made to embodiments of the present invention. It is to be understood, however, that the description is given by way of example only, and that the described embodiments are by no means to be understood as limiting the present invention thereto.

In particular, different exemplifying embodiments will be described using, as an example of an elevator system to which the embodiments may be applied, an elevator system as depicted and explained in connection with FIGS. 1 to 3.

It is to be noted that the following examples and embodiments are to be understood only as illustrative examples. Although the specification may refer to "an", "one", or "some" example(s) or embodiment(s) in several locations, this does not necessarily mean that each such reference is related to the same example(s) or embodiment(s), or that the feature only applies to a single example or embodiment. Single features of different embodiments may also be combined to provide other embodiments. Furthermore, terms like "comprising" and "including" should be understood as not limiting the described embodiments to consist of only those features that have been mentioned; such examples and embodiments may also contain features, structures, units, modules etc. that have not been specifically mentioned.

The general elements and functions of described elevator systems, details of which also depend on the actual type of elevator system, are known to those skilled in the art, so that a detailed description thereof is omitted herein. However, it is to be noted that several additional devices and functions besides those described below in further detail may be employed in an elevator system.

Figure 1:
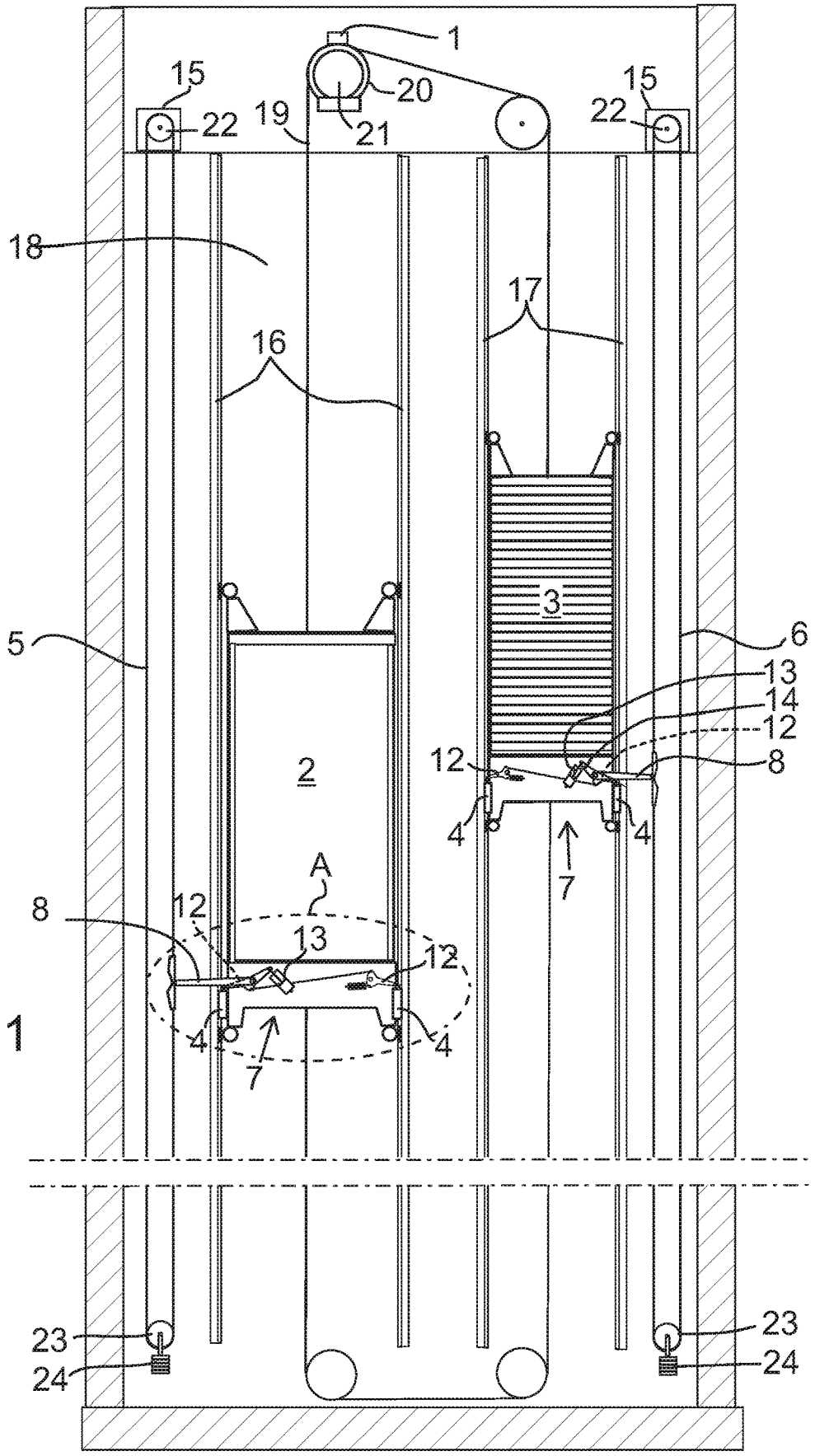
FIG. 1 schematically shows an elevator system according to one embodiment of the invention.
Figure 2:
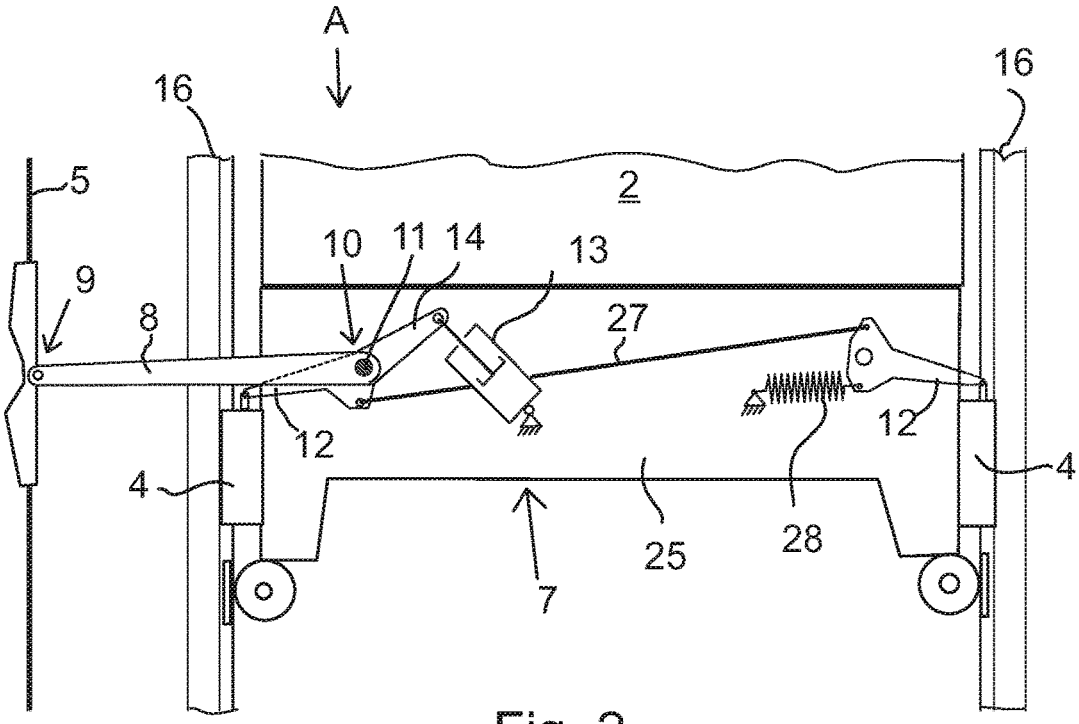
FIG. 2 shows a detail A from FIG. 1.
Figure 3:
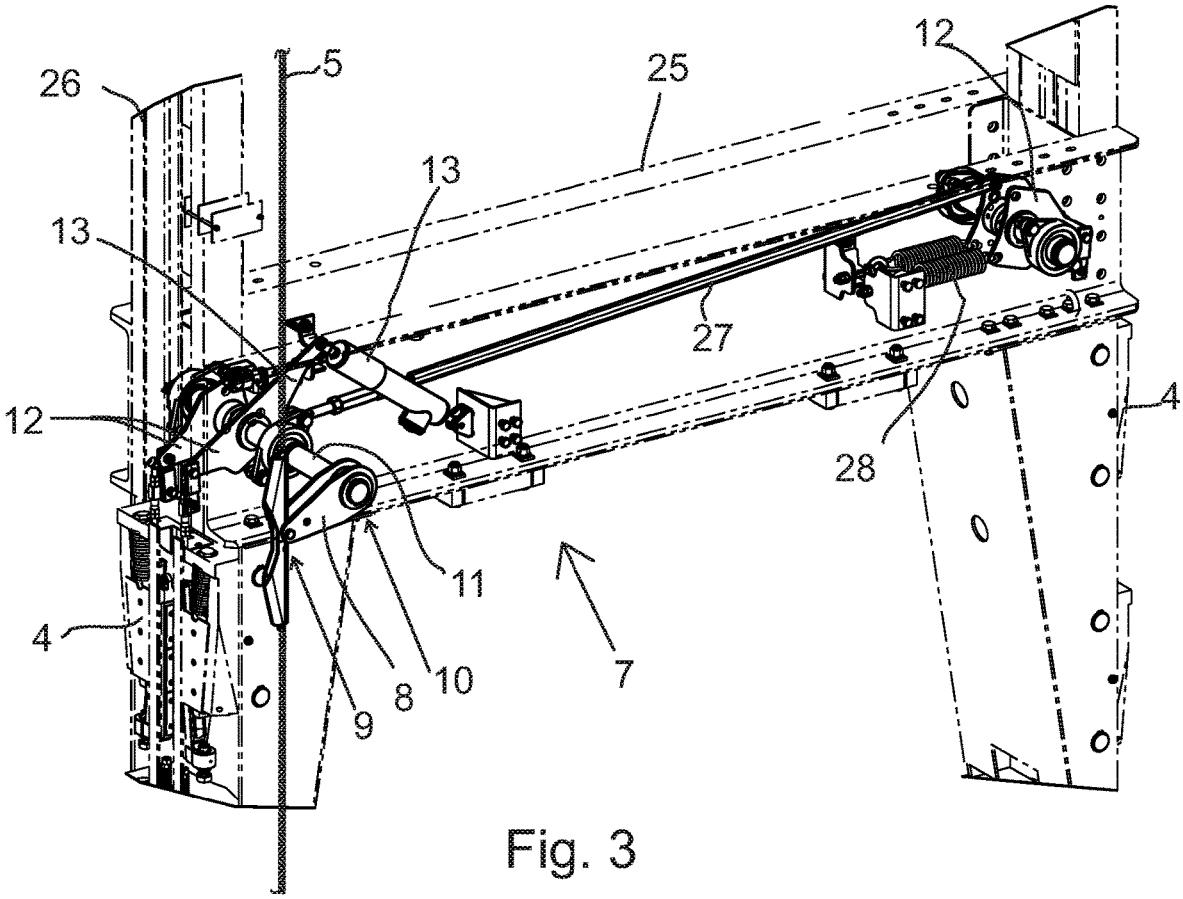
FIG. 3 is an axonometric view of the safety stopping arrangement according to one embodiment of the invention.

FIG. 1 shows an elevator system and FIGS. 2 and 3 show details of the same. The elevator system has an elevator car 2 and a counterweight 3, which are both acting as a moving mass and are connected to each other by suspension ropes 19. The suspension ropes 19 are going around a traction wheel 20 which is driven by a hoisting machine 21. A machinery brake 1 is arranged in connection with the hoisting machine for decelerating a moving mass 2, 3 so as to perform a quick stop of the moving mass. Because of the heavy mass hanging on both ends of the suspension ropes 19, the suspension ropes 19 do not slide on the traction wheel 20. When the traction wheel 20 is driven by the hoisting machine 21 and rotates, the elevator car 2 and the counterweight 3 move. The elevator car 2 and the counterweight 3 are guided by guide rails 16 and 17 which are mounted to the walls of the shaft 18 in which the elevator system 1 is provided.

FIG. 1 further shows an overspeed governor system 15 for the elevator car 2 which comprises an overspeed governor rope 5 both ends of which are connected to the elevator car 2 (the moving mass). The governor rope 5 goes around a governor pulley 22 on the top side of the elevator system and goes around a tension weight pulley 23 connected to a tension weight 24 on the bottom side of the elevator system. The governor rope 5 is connected to the elevator car 2 via a lever arm 8 of a synchronization linkage 7 having tripping arms 12 for tripping a safety gear 4 against both guide rails 16 of the elevator car 2.

FIG. 1 further shows an overspeed governor system 15 for the counterweight 3, which is similar to that explained for the elevator car 2. The overspeed governor system 15 for the counterweight 3 comprises an overspeed governor rope 6 both ends of which are connected to the counterweight 7 (the moving mass). The overspeed governor rope 6 goes around a governor pulley 22 on the top side of the elevator system and goes around a tension weight pulley 23 connected to a tension weight 24 on the bottom side of the elevator system. The governor rope 6 connected to the counterweight 7 via a lever arm 8 of a synchronization linkage 7 having tripping arms 12 for tripping a safety gear 4 against both guide rails of the counterweight 7.

Referring to FIGS. 2 and 3, a safety stopping arrangement has a synchronization linkage 7 is mounted to the moving mass, such as the elevator car 2 or counterweight 3 for tripping the safety gear 4. In this example of FIGS. 2 and 3 the synchronization linkage 7 is explained in connection with the elevator car 2, but the counterweight 3 can be equipped with similar synchronization linkage 7 as shown in FIG. 1. The synchronization linkage 7 is arranged in the lower beam 25 of the sling 26 of the elevator car 2.

The synchronization linkage 7 comprises a lever arm 8. The lever arm 8 has a first end 9 pivotally connected to the overspeed governor rope 5. A spindle shaft 11 is rotatably bearing-mounted to the lower beam 25. The second end 10 of the lever arm 8 is fixedly connected to the spindle shaft 11. A safety gear tripping arm 12 is also fixedly connected to the spindle shaft 11 so that turning of the lever arm 8 rotates the spindle shaft and turns the safety gear tripping arm 12. Another safety gear tripping arm 12 is arranged (on the right side of FIGS. 2 and 3) for tripping another safety gear 4 acting in co-operation with another guide rail 16. The synchronization linkage 7 comprises a connecting rod 27 which transmits the motion of the spindle shaft 11 to said another safety gear tripping arm 12. An extension spring 28 is arranged in the synchronization linkage 7 to oppose the tripping action. A viscous fluid damper cylinder 13 is arranged to dissipate kinetic energy caused by inertia of the overspeed governor rope 5 to the lever arm 8 to dampen the rotary movement of the spindle shaft 11. The fluid viscous damper dissipates energy by pushing fluid through an orifice, producing a damping pressure which creates a force. The fluid viscous damper cylinder acts on an auxiliary arm 14 which is also fixedly attached to the spindle shaft 11. In some other (not shown embodiments) the fluid viscous damper may arranged to act on any suitable moving member of the synchronization linkage 7, such as arm 14 or tripping arm 12 or connecting rod 27 connected directly or indirectly to the spindle shaft 11. In this example the fluid viscous damper cylinder 13 compresses when the inertia of the overspeed governor rope 5 urges the lever arm 8 to turn the spindle shaft 11 in a clockwise direction. In some other embodiment the fluid viscous damper cylinder 13 may be arranged to rebound in that situation.

Preferably, the fluid viscous damper 13 is an oil damper cylinder.

The fluid viscous damper cylinder 13 has at least two damping ratios depending on the velocity of the fluid viscous damper cylinder 13. The damping ratio of the fluid viscous damper cylinder may be adjustable.

Figure 4:
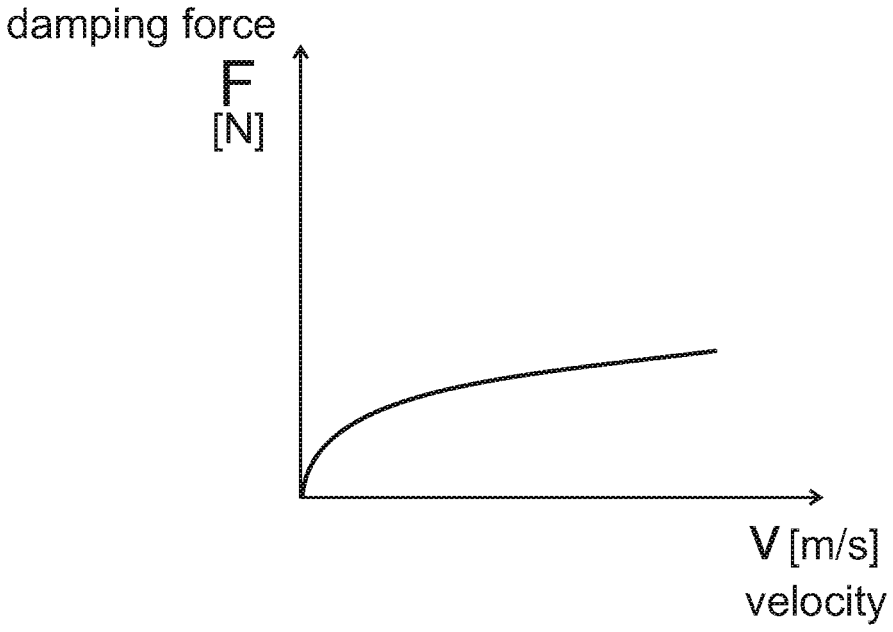
FIG. 4 is a diagram showing schematically the damping force being a non-linear function of the velocity of the piston relative to the cylinder of the fluid viscous damper cylinder in accordance with one embodiment of the invention.

FIG. 4 shows an example of how the damping force of the fluid viscous cylinder 13 can be arranged to vary in function of the velocity of the piston relative to the cylinder of the fluid viscous damper cylinder. The horizontal axis of the diagram represents the compression (or rebound) velocity of the fluid viscous damper cylinder. The vertical axis of the diagram represents the damping force F. The damping force F increases as a function of the velocity v. In the shown example, the damping force is a non-linear function of velocity of a piston relative to a cylinder of the fluid viscous damper cylinder. In smaller velocities the damping force is arranged to increase more forcibly than in higher velocities where the damping force increase is lightened. For example, the damping force function F(v) may be parabolic.

This ensures that the damping force will not be too high in a normal emergency stop situation wherein the overspeed governor system trips the safety gears, and this operation will not be substantially delayed due to the provision of the fluid viscous damping.

Although the invention has been the described in conjunction with a certain type of the elevator system, it should be understood that the invention is not limited to any certain type. While the present inventions have been described in connection with a number of exemplary embodiments, and implementations, the present inventions are not so limited, but rather cover various modifications, and equivalent arrangements, which fall within the purview of prospective claims.

The invention claimed is:

1. A method for avoiding unwanted safety gear tripping in a safety stopping system of an elevator system, the safety stopping system comprising:

a machinery brake for decelerating a moving mass so as to perform a quick stop of the moving mass;

a safety gear mounted to the moving mass;

an overspeed governor;

an overspeed governor rope connected to the moving mass of the elevator system; and a synchronization linkage mounted to the moving mass for tripping the safety gear, the synchronization linkage comprising a lever arm having a first end pivotally connected to the overspeed governor rope and a second end fixedly connected to a spindle shaft to which a safety gear tripping arm for tripping the safety gear is connected, said method comprising the steps of:

dissipating kinetic energy caused by inertia of the overspeed governor rope to the lever arm by implementing fluid viscous damping to dampen a rotary movement of the spindle shaft to prevent unwanted safety gear tripping when the upwards movement of the moving mass is decelerated by the machinery brake to perform a quick stop of the moving mass; and performing the fluid viscous damping by a fluid viscous damper cylinder acting on an arm or a rod connected directly or indirectly to the spindle shaft.

2. The method according to claim 1, wherein the damping force is a non-linear function of velocity of a piston relative to a cylinder of the fluid viscous damper cylinder.

3. The method according to claim 2, wherein in velocities of the piston relative to the cylinder of the fluid viscous damper cylinder smaller than a predetermined velocity the damping force is arranged to increase more forcibly than in higher velocities.

4. The method according to claim 1, wherein the fluid viscous damper cylinder is an oil damper cylinder.

5. The method according to claim 4, wherein the damping force is a non-linear function of velocity of a piston relative to a cylinder of the fluid viscous damper cylinder.

6. The method according to claim 1, wherein the moving mass is an elevator car.

7. The method according to claim 1, wherein the moving mass is a counterweight.

8. An elevator system comprising:

a moving mass guided by a pair of guide rails to be vertically movable in an elevator shaft;

a suspension rope attached to the moving mass;

a traction wheel over which the suspension rope is lead;

a hoisting machine for driving the traction wheel to move the moving mass; and the safety stopping arrangement according to claim 7.

9. A safety stopping arrangement for an elevator system for stopping a movement of the moving mass, the safety stopping arrangement comprising:

a machinery brake for decelerating a moving mass so as to perform a quick stop of the moving mass;

a safety gear mounted to the moving mass;

an overspeed governor;

an overspeed governor rope attached to the moving mass of the elevator system;

a synchronization linkage mounted to the moving mass for tripping the safety gear, the synchronization linkage comprising:

a lever arm having a first end pivotally connected to the overspeed governor rope and a second end;

a spindle shaft to which the second end of the lever arm is fixedly connected; and a safety gear tripping arm for tripping the safety gear, the safety gear tripping arm being fixedly connected to the spindle shaft; and a fluid viscous damper arranged to dissipate kinetic energy caused by inertia of the overspeed governor rope to the lever arm to dampen the rotary movement of the spindle shaft; wherein the fluid viscous damper is a fluid viscous damper cylinder acting on an arm or rod connected directly or indirectly to the spindle shaft.

10. The safety stopping arrangement according to claim 9, wherein the fluid viscous damper cylinder is an oil damper cylinder.

11. The safety stopping arrangement according to claim 9, wherein the damping force is a non-linear function of velocity of a piston relative to a cylinder of the fluid viscous damper cylinder.

12. The safety stopping arrangement according to claim 9, wherein the moving mass is an elevator car.

13. The safety stopping arrangement according to claim 9, wherein the moving mass is a counterweight.

* * * * *